US006127778A

United States Patent [19]

Op Het Veld et al.

[11] Patent Number: 6,127,778

[45] Date of Patent: Oct. 3, 2000

[54] LAMPHOLDER AND LIGHTING UNIT COMPRISING A LAMPHOLDER

[75] Inventors: Johannes H. G. Op Het Veld; Lambertus J. M. Bouwman; Adrianus M. J. De Bijl, all of Eindhoven, Netherlands

[73] Assignee: U.S. Philips Corporation, New York, N.Y.

[21] Appl. No.: 08/972,509

[22] Filed: Nov. 18, 1997

[30] Foreign Application Priority Data

Nov. 20, 1996 [EP] European Pat. Off. ..... 96203258

[51] Int. Cl.[7] ..... H01J 7/44

[52] U.S. Cl. ..... 313/594; 313/601; 313/602; 313/607; 315/85; 315/56

[58] Field of Search ..... 313/594, 601, 313/607, 602; 315/85, 56

[56] References Cited

U.S. PATENT DOCUMENTS 2,142,047 12/1938 Cox ..... 313/594

4,449,071 5/1984 Yokoyama ..... 313/607

FOREIGN PATENT DOCUMENTS 1531280 11/1978 United Kingdom ..... H01J 61/02

2066559A 7/1981 United Kingdom ..... H01J 61/56

*Primary Examiner*—Michael B Shingleton

*Attorney, Agent, or Firm*—F. Brice Faller

[57] ABSTRACT

A lampholder in accordance with the invention can suitably be used for a low-pressure discharge lamp (a) which operates at a high frequency and which comprises an elongated, tubular discharge vessel (b), said lamp being provided with a pair of electrodes (c, c') for maintaining an electric discharge in the discharge vessel. The lampholder (0) has contacts (1, 1') for connecting a high-frequency power supply (4), said contacts being electrically connected to a first (2) and a second terminal (2') for connecting the lamp. The second terminal is further removed from the contacts than the first terminal. A compensation conductor (6) extending between the first (2) and the second terminal (2') is connected to said first terminal (2). This leads to a reduction of conducted interference.

11 Claims, 3 Drawing Sheets

LAMPHOLDER AND LIGHTING UNIT COMPRISING A LAMPHOLDER

BACKGROUND OF THE INVENTION

The invention relates to a lampholder which can suitably be used for a low-pressure discharge lamp which operates at a high frequency and which comprises an elongated, tubular discharge vessel, the lamp being provided with a pair of electrodes for maintaining an electric discharge in the discharge vessel. The lampholder has contacts for connecting a high-frequency power supply, the contacts being electrically connected to a first and a second terminal for connecting the lamp, the second terminal being further removed from the contacts than the first terminal.

The invention further relates to a lighting unit comprising a lampholder.

A lamp for use in such a lampholder is known from GB 2066559. This Patent document provides a solution for counteracting interference caused by high-frequency magnetic fields. Another type of interference is caused by conduction via the mains. In this type of interference, hereinafter also referred to as conducted interference, high-frequency voltage variations of the discharge arc with respect to ground cause a high-frequency current to flow from the lamp vessel, via parasitic capacitances between the lamp and ground, via ground, via parasitic capacitances between ground and the mains, and via the power supply back to the lamp vessel. Particularly in low-pressure discharge lamps which operate at high frequencies and which have a relatively long discharge vessel, for example in excess of 50 cm, this type of interference plays an important role as the relatively large surface of the discharge vessel results in a large capacitance between the discharge vessel and ground. This type of interference does not only cause interference at the frequency at which the lamp operates but also at higher harmonics thereof since the voltage across the interference sources, in particular the discharge arc and electrodes, deviates substantially from the sine shape.

SUMMARY OF THE INVENTION

It is an object of the invention to provide a measure by means of which conducted interference can be counteracted. To achieve this, a compensation conductor extending between the first and the second terminal is connected to the first terminal. A parasitic current, which is in phase opposition to the parasitic current flowing via the parasitic capacitance between ground and the conductor to the second terminal, can flow via the parasitic capacitance between ground and the compensation conductor. As a result, the parasitic current flowing via the power supply to the mains is reduced. Although the compensation conductor preferably extends as far as or beyond the second terminal, favorable results are also achieved with a compensation conductor extending over a part of the length between the first and the second terminal. The compensation conductor may be integral with the conductor connecting the first terminal to its contact, for example by bending the latter conductor so as to be U-shaped, with a first part extending from the contact to a location beyond the first terminal and a second part extending from the location to the first terminal. The second part and the region of the first part situated between the terminal and the location then form the compensation conductor.

It is noted that a high-pressure discharge lamp comprising a first terminal which is connected to a conductor extending towards the second terminal is disclosed in GB 1531280.

The conductor must counteract migration of filling constituents from the discharge vessel. In low-pressure discharge lamps, whose discharge vessel is at a relatively low temperature, this phenomenon occurs hardly, or perhaps not at all.

Also the voltage drop across the electrodes of the lamp is responsible to a substantial degree for guided interference. In order to counteract also this type of interference, a metal plate can be connected to each of the terminals. The voltage drop across the electrodes causes a current which flows, via the parasitic capacitance between ground and the lamp vessel, via parasitic capacitances of the mains and ground, and via the power supply, to the electrodes. By means of the metal plates connected to the terminals, an additional capacitance is created between the electrodes and ground. This causes a substantial part of the current which otherwise would flow via the mains to flow via the additional capacitance.

In a favorable embodiment, the metal plates also serve as a reflector.

A low-pressure discharge lamp may be in one piece with the lampholder or may be detachably provided therein.

The lampholder may be provided with further contacts, which are accessible from without, and which are connected to the contacts for connecting the high-frequency power supply, the further contacts and the contacts being provided at opposing ends and being constructed so that they cooperate with each other. By virtue thereof, the lampholders can be connected to each other, with the further contacts of the lampholder forming the high-frequency power supply for the contacts of a neighboring lampholder.

Preferably, the lampholder in accordance with the invention forms part of a lighting unit in accordance with the invention which further comprises a high-frequency power supply which is provided with a transformer having a primary and a secondary winding, with the contacts of the lampholder being connected to the secondary winding of the transformer. The transformer electrically separates the DC/AC-converter and the lampholder, which results in a further reduction of the electromagnetic interference.

These and other aspects of the invention will be apparent from and elucidated with reference to the embodiments described hereinafter.

DETAILED DESCRIPTION OF THE PREFERRED EMBODIMENTS

Figure 1:
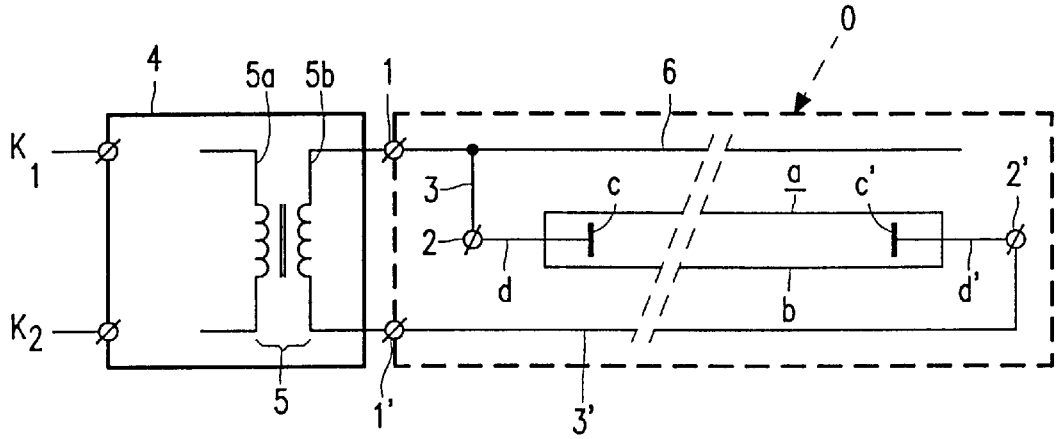
FIG. 1 and FIG. 2 successively show a first and a second embodiment of the lampholder in accordance with the invention. These Figures also schematically show a power supply.

FIG. 1 shows a first embodiment of a lampholder 0 which is suitable for a low-pressure discharge lamp a, which operates at a high frequency and which comprises an elongated, tubular discharge vessel b, the lamp being provided with a pair of electrodes c, c' which are accommodated in the discharge vessel. In this case, a low-pressure mercury discharge lamp a having a discharge vessel b with a length of 77 cm and an outside diameter of 3.2 mm is accommodated in the lampholder 0. The lampholder 0 has opposed first and second ends with primary contacts 1, 1' at said first end for connecting a high-frequency power supply 4, and a first terminal 2 and a second terminal 2' to which lamp contacts d, d' are connected. The second terminal 2' is further removed from the contacts 1, 1' than the first terminal 2. Copper conductors 3, 3' having a diameter of 0.8 mm extend from the contacts 1, 1' to the terminals 2, 2'. The lampholder 0 forms part of a lighting unit in accordance with the invention, which further comprises a high-frequency power supply 4 which is provided with a transformer 5 having a primary winding 5*a* and a secondary winding 5*b*. In this case, the high-frequency power supply 4 comprises an AC/DC-converter (not shown) for converting a mains (line) voltage supplied to mains-connection terminals K1, K2 to a direct current, and a DC/AC-converter (not shown) for converting the direct current to a high-frequency alternating current of, in this case, 28 kHz, at an output (not shown) to which the primary winding 5*a* of the transformer 5 is connected. The contacts 1, 1' of the lampholder are connected to the secondary winding 5*b*. In the embodiment shown, the primary winding 5*a* has 179 turns. The secondary winding, 5*b* has 1998 turns which are distributed among, 6 sections, which are separated from each other by insulating partitions and which each comprise 333 turns.

A compensation conductor 6 is connected to the first terminal 2 and extends between the first terminal 2 and the second terminal 2'. In this case, the compensation conductor 6 does not form part of the conductor 3 extending from the first terminal 2 to its contact 1. The compensation conductor 6 extends throughout the length of the discharge vessel (77 cm) and, just like the other conductors 3, 3', has a diameter of 0.8 mm.

Figure 2:
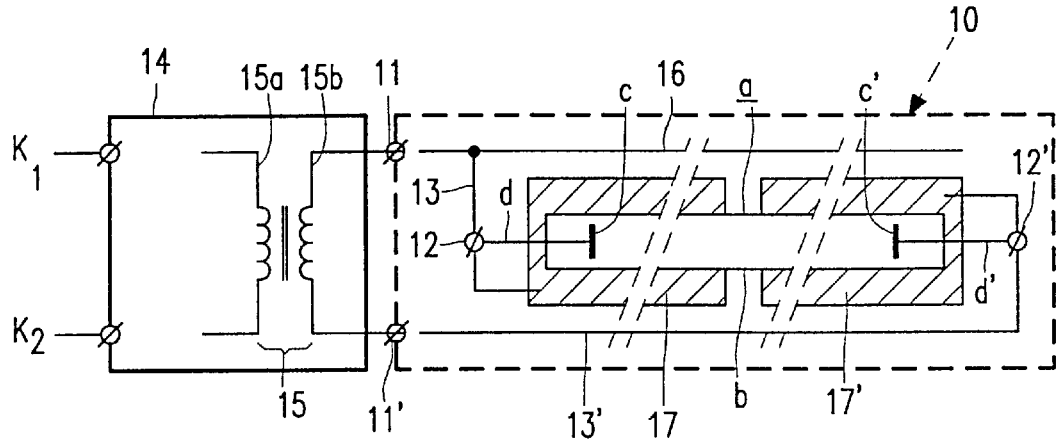

A second embodiment of a lampholder is shown in FIG. 2. Parts corresponding to parts shown in FIG. 1 are indicated by a reference numeral which is increased by 10. In this embodiment, each one of the terminals 12, 12' is connected to a metal plate 17, 17'. The metal plates 17, 17' form a concave reflector having a depth of 10 mm and a maximum width of 8 mm.

In accordance with the CISPR-15 standard for the average-value measurement, conducted interference in the frequency range from 10 kHz to 30 MHz on the mains-connection terminals K1, K2 of the lighting units in accordance with the invention was measured (inv1 and inv2, respectively), as shown in FIG. 1 and FIG. 2, respectively. For comparison, also the conducted interference on the mains-connection terminals of a lighting unit (ref), not in accordance with the invention, was measured. The difference between the lighting unit (ref) and the lighting unit "inv1" in accordance with FIG. 1 is that the former does not comprise a compensation conductor. For the rest, the lighting units "inv1" and "ref" are identical.

Figure 3A:
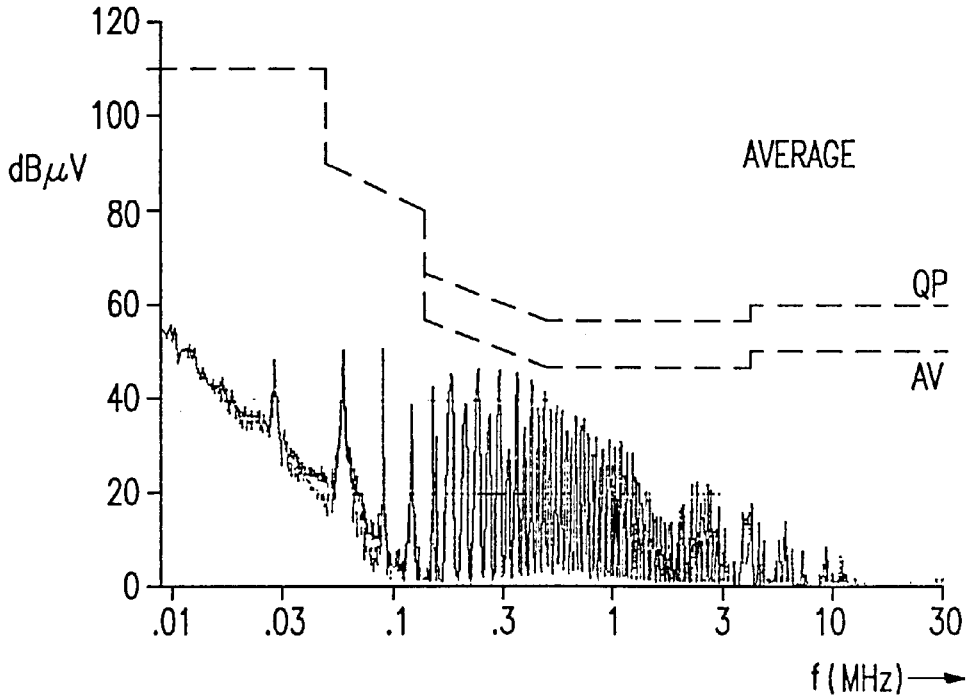
FIGS. 3A through 3C show measuring results of conducted interference in dB$\mu$V as a function of the frequency in MHz.
Figure 3B:
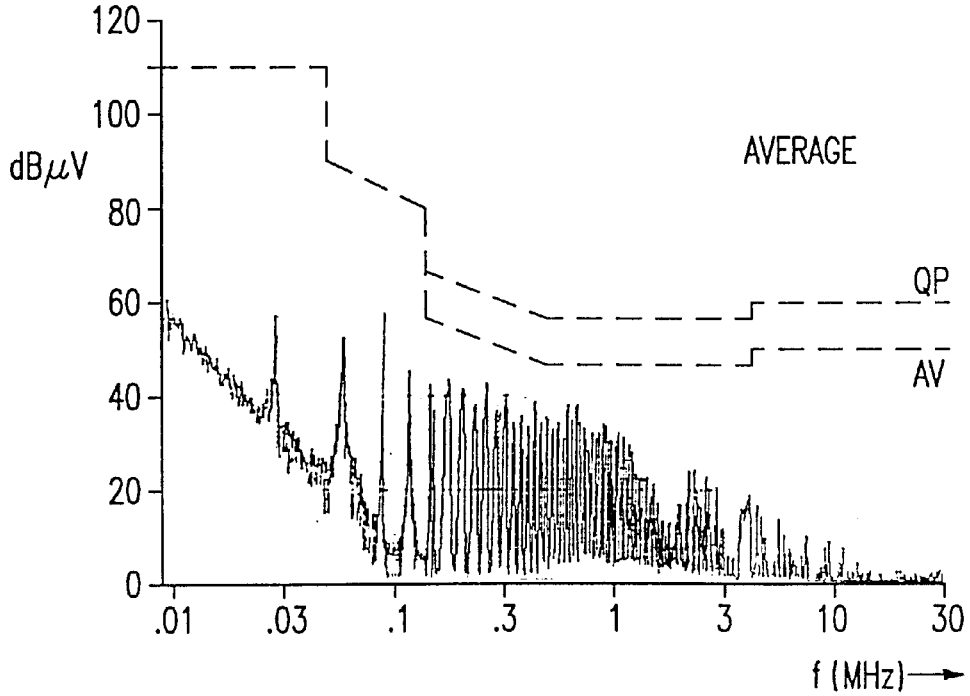
Figure 3C:
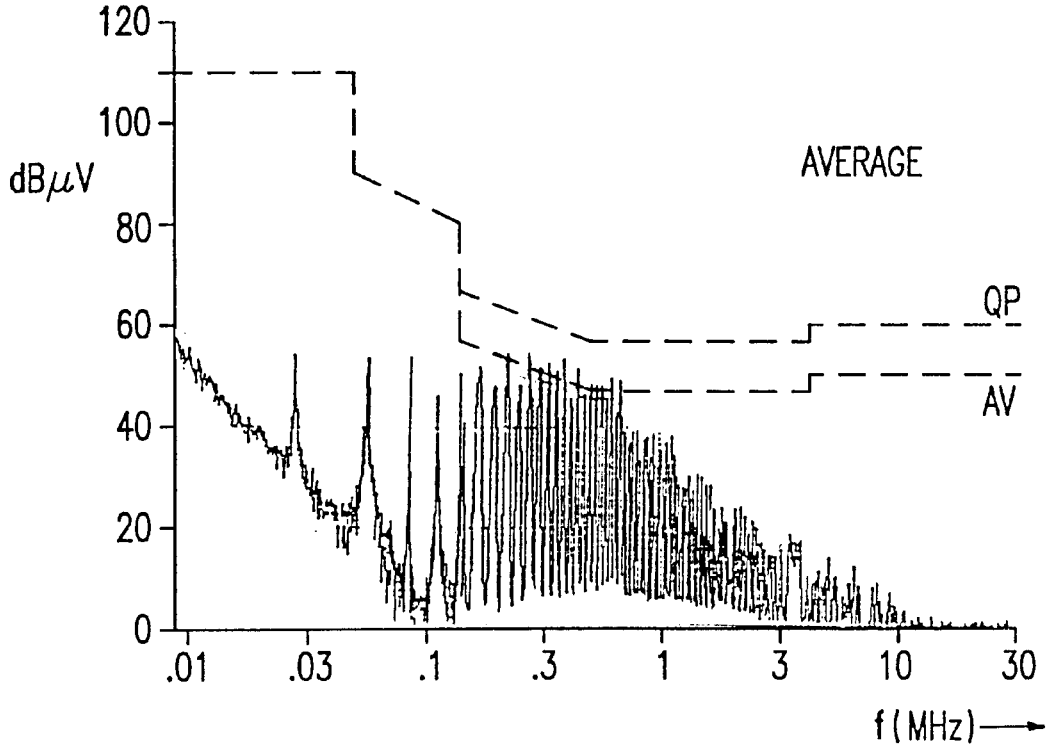

The level (in dB$\mu$V) of the conducted interference, measured in the lighting units "inv1", "inv2" and "ref", as a function of the frequency (in MHz) is successively shown in FIGS. 3A, 3B and 3C. These measurements show that the lighting unit comprising the lampholder which is not in accordance with the invention exceeds the CISPR-15 standard for the average value in the range from 0.23 MHz to 0.72 MHz. The lighting unit "inv1" meets the standard throughout the range from 10 kHz to 30 MHz. An even stronger reduction of the interference is achieved by means of the lighting unit "inv2".

Figure 4:
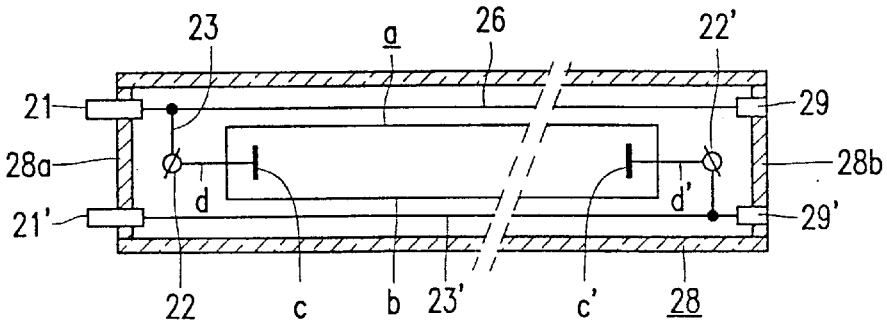
FIG. 4 shows a third embodiment of the lampholder in accordance with the invention.

FIG. 4 shows a further embodiment of the lampholder in accordance with the invention. Parts which correspond to parts shown in FIG. 1 bear a reference numeral which is increased by 20. In the case of the lampholder 20 shown, the discharge vessel b is accommodated in a transparent housing 28 which is provided at a first end 28*a* with contacts 21, 21' which are constructed as contact pins which are accessible from without. At a second, opposing end 28*b*, the lampholder 20 is provided with further contacts 29, 29', which are constructed as contact sockets which are accessible from without. The further contacts 29, 29' are connected to the contacts 21, 21' for connecting a high-frequency power supply, via the conductor 23' which extends to the second terminal 22' and via the compensation conductor 26. The contact pins 21, 21' and the contact sockets 29, 29' of the lampholder are mateable with each other. By virtue thereof, lampholders of this construction can readily be used to form a chain by connecting contact pins of lampholders in the chain to contact sockets of the neighboring lampholder.

We claim:

1. A lampholder (0; 10, 20) for a low-pressure discharge lamp (a) which operates at a high frequency and which comprises an elongated, tubular discharge vessel (b) having opposed ends, said lamp being provided with a pair of electrodes (c, c') at said opposed ends for maintaining an electric discharge in the discharge vessel, said lampholder comprising a pair of contacts for connecting a high-frequency power supply (4; 14), said contacts being electrically connected to a first terminal (2; 12; 22) and a second terminal (2'; 12'; 22') for connecting the lamp, said second terminal being further removed from the contacts than the first terminal, said lamp holder further comprising a compensation conductor extending between the first terminal and the second terminal said compensation conductor being connected to said first terminal but not to the second terminal.

2. A lampholder as claimed in claim 1, characterized in that a metal plate (17, 17') is connected to each of the terminals (12, 12').

3. A lampholder as claimed in claim 2, characterized in that the metal plates each form a concave reflector which receives an end of the lamp.

4. A lampholder as claimed in claim 1, characterized in that the lampholder (20) is provided with further contacts (29, 29'), which are accessible from without, and which are connected to the contacts (21, 21') for connecting the high-frequency power supply, said compensation conductor connecting said first terminal to one of said further contacts, said second terminal being connected to another of said further contacts, said further contacts (29, 29') and the contacts (21, 21') being provided at opposing ends (28*a* and 28*b*, respectively) and being mateable with each other so that a plurality of said lampholders can be connected to form a chain.

5. A lighting unit comprising a lampholder (0; 10), as claimed in claim 1, and a high-frequency power supply (4; 14) which is provided with a transformer (5; 15) having a primary and a secondary winding (5*a*, 5*b*; 15*a*, 15*b*), with the contacts (1, 1'; 11, 11') of the lampholder (0; 10) being connected to the secondary winding (5*b*; 15*b*) of the transformer (5; 15).

6. A lighting unit comprising a low pressure discharge lamp comprising a tubular discharge vessel having opposed ends and a pair of electrodes at said opposed ends for maintaining an electric discharge in the discharge vessel, a lampholder having a pair of contacts for connecting to a power supply, said contacts being connected to respective first and second terminals connected to respective electrodes, said second terminal being more remote from the contacts than said first terminal, and a compensation conductor connected to said first terminal and extending toward said second terminal parallel to said tubular discharge vessel but not connected to said second terminal.

7. A lighting unit as in claim 6 further comprising a high frequency power supply comprising a transformer having a primary winding and a secondary winding, said secondary winding being connected to said contacts.

8. A lampholder for an elongate discharge lamp having a pair of opposed electrodes, said lampholder comprising first and second opposed ends, first and second primary contacts at said first end for connecting to a high frequency power supply, a first terminal toward said first end for connecting to one of said electrodes, said first terminal being connected to said first primary contact, a second terminal toward said second end for connecting to another of said electrodes, said second terminal being connected to said second primary contact, and a compensation conductor connected to said first terminal and extending toward but not connected to said second terminal.

9. A lampholder as in claim 8 further comprising a metal plate connected to each of said first and second terminals.

10. A lampholder as in claim 9 wherein each of said metal plates is a concave reflector which receives an end of the lamp.

11. A lampholder as in claim 8 further comprising first and second secondary contacts at said second end, said first and second primary contacts being electrically connected to respective said first and second secondary contacts, said first terminal being connected to said first secondary contact by said compensation conductor, said primary contacts being mateable with said secondary contacts so that said lampholders can be connected in a chain.

* * * * *